US005333529A

United States Patent [19]

Brockman

[11] Patent Number: 5,333,529

[45] Date of Patent: Aug. 2, 1994

[54] CONVERTIBLE MUZZLE BRAKE

[75] Inventor: James W. Brockman, Alpine, Tex.

[73] Assignee: Rott & Company, Clay Center, Kans.

[21] Appl. No.: 2,477

[22] Filed: Jan. 8, 1993

[51] Int. Cl.[5] ..... F41A 21/38

[52] U.S. Cl. ..... 89/14.3; 42/79

[58] Field of Search ..... 89/14.2, 14.3, 14.4, 89/14.5; 42/79

[56] References Cited

U.S. PATENT DOCUMENTS

| | | | |
|---|---|---|---|
| 2,423,109 | 7/1947 | Monnet | 89/14.4 |
| 2,484,998 | 10/1949 | Hutchinson | 89/14.3 |
| 2,770,904 | 11/1956 | Weiss | 89/14.3 |
| 2,859,444 | 11/1958 | Reymond | 89/14.3 |
| 2,869,272 | 1/1959 | Coyle | 42/79 |
| 2,883,781 | 4/1959 | Harvey | 89/14.3 |

*Primary Examiner*—David H. Brown

*Attorney, Agent, or Firm*—Shook, Hardy & Bacon

[57] ABSTRACT

A firearm muzzle brake having an outer sleeve with holes alignable with corresponding openings in a member telescoped in the sleeve to jointly conduit discharge gases in a direction to oppose the recoil in the firearm. The sleeve is rotatably mounted on the inner member so that it is movable to a position blocking the gases from flowing in the recoil opposing direction. A detent releasably locks the sleeve in either position.

10 Claims, 1 Drawing Sheet

CONVERTIBLE MUZZLE BRAKE

BACKGROUND OF THE INVENTION

The present invention relates to firearms and, more specifically, to a convertible muzzle brake.

When a firearm is fired, the explosion within the chamber of the weapon creates essentially two forces. Obviously, the discharge creates a forward force propelling a projectile forward from the firearm. However, an equal and opposite force is directed against the firearm. This rearward force travels through the firearm and is applied against the shoulder of the firearm user. This rearward energy transfer is known as recoil.

Recoil is a substantial concern for shooters of relatively high-powered rifles and of shotguns. This concern is becoming more intense as firearm designers devise lighter weight firearms utilizing more powerful loads. The recoil encountered by discharging such high-powered firearms creates several problems for the shooter.

First, the recoil produced by discharging a large bore firearm can be very unpleasant, if not painful and injurious, to the user. Depending upon the caliber and powder load of a particular round, the rearwardly directed energy from a large bore firearm can bruise the shoulder of the shooter. Consequently, the discomfort associated with the recoil "kick" deters some shooters from using certain calibers and loads.

Second, since the recoil vector is usually directed above the vertical mid-line of the stock of a firearm, recoil often results in an upward jump of the firearm's muzzle. As the muzzle jumps, the target is at least partially occluded by the barrel, causing the shooter to lose sight of the target. This muzzle jump requires that the firearm be realigned after each discharge, causing a distraction and in interruption of concentration. Thus, recoil also interferes with shooting accuracy.

Third, as a proximate result of the unpleasantness associated with recoil, a shooter who has experienced substantial recoil will often manifest a flinching reflex immediately prior to discharging the firearm. When the user flinches, the firearm will move off target just as the user pulls the trigger. This flinching reflex acts to further reduce accuracy even when the shooter discharges single rounds. The reduction in accuracy from flinching is yet more pronounced during repetitive firing of the firearm.

Those skilled in the art of ballistics and firearm design have made attempts to alleviate the problems associated with recoil. It has been found that an effective means to reduce the problems associated with recoil is to reduce the recoil energy itself. A device commonly used for this purpose is a muzzle brake.

A muzzle brake is a device consisting of one or more sets of baffles or lateral portals located at the muzzle end of a firearm barrel. A muzzle brake reduces recoil force and also reduces obscuration of the target resulting from muzzle jump. After the projectile exits the muzzle following discharge of the firearm, some of the powder gases are decelerated and deflected by the muzzle brake to the sides and rear of the gun. The reaction to the change of direction of the escaping gases exerts a forward pulling force on the muzzle brake and, in turn, on the firearm. This reduces the rearwardly directed force component which causes the recoil. In effect, the muzzle brake harnesses the cause of recoil and converts it into a partial cure. The result is greater barrel stability, improved accuracy, and a shorter length of recoil.

Presently available muzzle brakes have an undesirable side effect. Though the laterally directed baffles on the muzzle brake reduce recoil, they also increase the objectionable sound of the discharge in the area immediately surrounding the firearm. The result is a substantial increase in muzzle blast. This increase makes discharging a firearm equipped with a muzzle brake unpleasant for both the firearm user and for persons in the near vicinity.

Ironically, though a muzzle brake reduces the flinch reflex associated with recoil, it gives rise to a similar flinch reflex in anticipation of the increased muzzle blast. As a result, even if the shooter gains increased accuracy by reducing recoil, the shooter may encounter a corresponding decrease in accuracy resulting from muzzle blast flinch.

Firearm users often use hearing protectors while discharging a muzzle brake equipped firearm at a practice range only to later remove the muzzle brake for actual hunting in the field where the hunter and his fellow hunters may not have such protectors. This practice actually negates any accuracy advantage achieved by using the brake. Muzzle brakes are of significant weight and are placed at the outer end of the barrel. They greatly affect the mass profile of the firearm. Consequently, muzzle brake removal will cause substantial deviation in barrel performance upon aiming and discharge. Therefore, though a firearm sighted with a muzzle brake may prove reasonably accurate, the same firearm may not be fired as accurately when the muzzle brake has been removed.

It is therefore a primary object of the present invention to provide a muzzle brake designed to effectively reduce recoil while at the same time allowing for a high degree of accuracy.

Specifically, it is an object of the present invention to provide a muzzle brake which may be functionally engaged and disengaged as may be derived without the necessity for removal of the muzzle brake from the firearm.

It is also an object of the present invention to provide a muzzle brake which is suitable for a plurality of shooting situations and is capable of meeting a variety of shooting demands with little physical manipulation by the firearm user.

The above and other objects of the invention will in part be obvious and will be hereinafter more fully pointed out in connection with the detailed description of the accompanying drawings.

SUMMARY OF THE INVENTION

The present invention relates to a convertible muzzle brake. In the preferred form, it comprises a rigid cylindrical tube adapted to be affixed to the end of a firearm barrel- This tube presents a plurality of openings extending transversely through its sidewalls. A cylindrical sleeve is disposed concentrically around the tube. This sleeve also has a plurality of openings extending through its sidewalls. The openings presented by the sleeve are alignable to the openings presented by the tube.

The sleeve and tube are joined by a means allowing one to slidably rotate with respect to the other. This permits the muzzle brake to be placed in an engaged condition wherein the openings of the sleeve are aligned with the openings of the tube. This joining means also allows the muzzle brake to be functionally disengaged wherein the openings in the sleeve are not aligned with the openings in the tube.

When the muzzle brake is functionally engaged, some of the gases produced when the firearm is discharged escape laterally through the openings presented by the device. This lateral flow of discharge gases significantly reduces both recoil and muzzle jump.

When the muzzle brake is disengaged, the gases produced by the discharge of the firearm escape through the end of the barrel behind the projectile. The disengaged muzzle brake produces no braking effect on the firearm. When disengaged, the muzzle brake remains rigidly affixed to the end of the barrel of the firearm, thereby preserving the length and mass profile of the firearm.

BRIEF DESCRIPTION OF THE DRAWINGS

The accompanying drawings which form part of this specification and are to be read in conjunction therewith and in which like numbers have been used to indicate like parts in the various views.

DESCRIPTION OF THE PREFERRED EMBODIMENT

Figure 1:
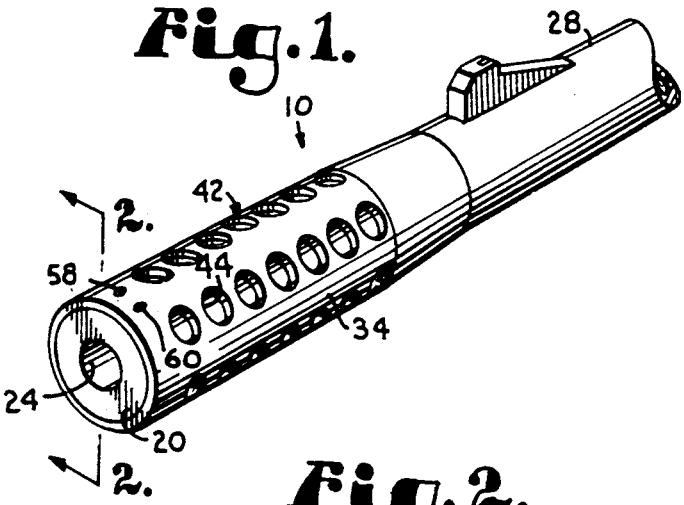
FIG. 1 is a front perspective view on a reduced scale of a muzzle brake constructed in accordance with the present invention shown installed on a firearm which appears fragmentally.

A muzzle brake embodying the principals of this invention is broadly designated in the drawings by the reference numeral 10 and comprises an elongated rigid tubular member 12 of transversely circular configuration having one end 14 of substantially reduced cross-section and an intermediate section 16 of slightly greater diameter separated from end 14 by a shoulder 18. The outermost end 20 of member 12 is of still greater diameter and is separated from section 16 by a shoulder 22.

Member 12 is provided with an axially extending passage or bore 24 which is alignable with bore 26 of the firearm barrel 28 to which the muzzle brake is to be attached. Bore 24 is disposed to permit the passage of a projectile from bore 26 of the firearm barrel through the muzzle brake.

A plurality of rows 30 of openings 32 extend transversely through the sidewall of the tubular member 12 substantially as shown in the drawing. The openings 32 communicate bore 24 with the exterior surface of member 12 to permit the escape of discharged gases emanating from the firearm bore 26 in a manner conventional for the operation of muzzle brakes. The sidewall of member 12 is sufficiently thick to permit the gases emanating through openings 32 to act upon the muzzle brake to pull the firearm in a forward direction as will be readily understood by those skilled in the muzzle brake art and as will be subsequently discussed.

Figure 2:
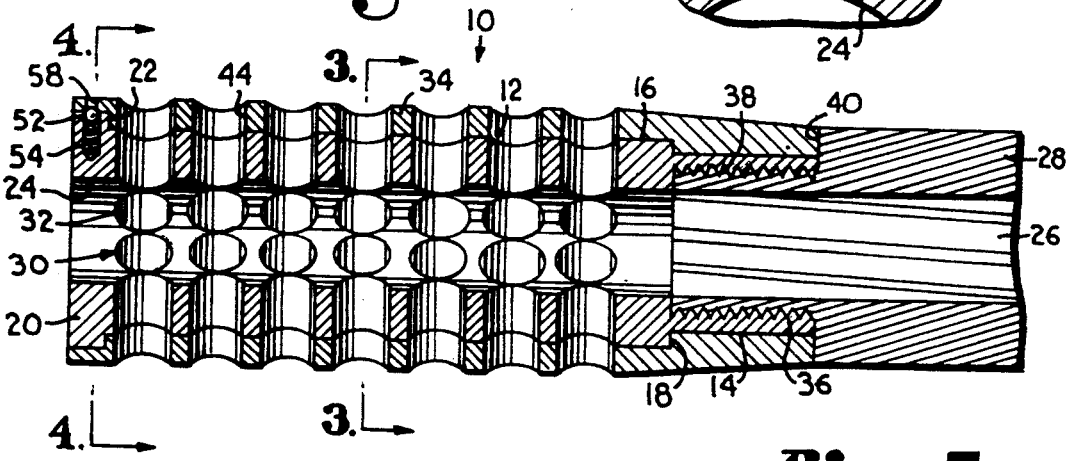
FIG. 2 is a fragmentary, detailed cross-sectional view taken along line 2—2 of FIG. 1 showing the muzzle brake in its engaged condition.
Figure 5:
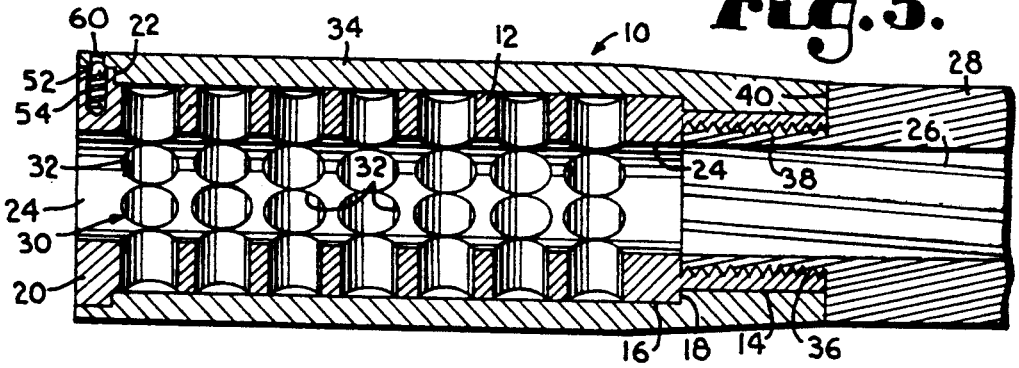
FIG. 5 is a view similar to FIG. 2 but showing the muzzle brake in its disengaged condition.

Telescoped over member 12 and having an interior surface which is configured to generally complimentally conform to the outer surface of member 12 is an elongated rigid tubular sleeve 34. Sleeve 34 is telescoped over member 12 before the latter is rigidly attached to the muzzle of the firearm, as best shown in FIGS. 2 and 5 of the drawing. The inner end 14 of member 12 is provided with internal threads 36 which complimentally engage corresponding threads machined on the extreme outer marginal end portion 38 of barrel 28 as shown in the drawing.

As illustrated, the end of barrel 28 is preferably machined to the appropriate diameter to accommodate the threaded attachment of the muzzle brake to the barrel as shown. The machining of the barrel presents a shoulder 40 engageable by the proximal end of sleeve 34 to limit movement of the sleeve axially of member 12 in one direction. The shoulder 22 on the outer end portion 20 of member 12 limits axial movement of the sleeve in the other direction and constrains the sleeve to relative rotational movement with respect to the member permitted by the transversely circular configuration of the outer surface of member 12 and the inner surface of sleeve 34. Sleeve 34 and member 12 are concentric and the sleeve is mounted for rotation about the axis of member 12.

Sleeve 34 is provided with a plurality of rows 42 of holes 44 which extend transversely through the sidewall of sleeve 34. The holes 44 of the rows of holes 42 in sleeve 34 are respectively disposed for alignment with corresponding rows 30 of openings 32 in member 12 to permit alignment of the holes with the corresponding openings whereby each aligned hole and opening of the sleeve and member respectively provides a conduit 46 communicating passage 24 with the exterior of the muzzle brake for the escape of discharged gases through the conduit. The position of relative rotation of the sleeve with respect to the member to dispose the respective holes and openings into corresponding alignment is shown best in FIGS. 2 and 3 of the drawing.

Figure 4:
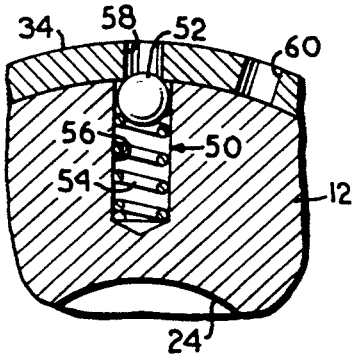
FIG. 4 is an enlarged, fragmentary cross-sectional view taken along line 4—4 of FIG. 2 showing the detent ball and spring mechanism used to maintain the engaged and disengaged conditions of the muzzle brake.
Figure 6:
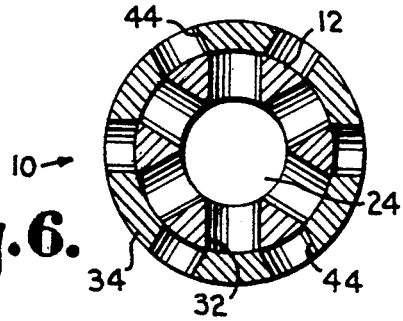
FIG. 6 is a view similar to FIG. 3 but showing the muzzle brake in disengaged condition.

Sleeve 34 is provided with a plurality of areas 48 intermediate the rows 42 of holes 44. The areas 48 are moveable by rotation of the sleeve on the member into positions blocking the openings 32 through the member. Manifestly, the openings 44 are moved by such rotation out of alignment with the corresponding openings 32. This position of relative rotation whereby the gas discharge openings through member 12 are effectively blocked by the sleeve is illustrated in FIGS. 5 and 6 of the drawing. This second position of relative rotation of the sleeve with respect to the member prevents the sideward discharge of gases through the muzzle brake and effectively disables brake 10 to function as a muzzle brake for the firearm. It will be readily appreciated that, with the brake in the non-functioning position shown in FIGS. 5 and 6 of the drawing, the firearm can be used in conventional fashion and the projectile and discharged gases can move through the axial passage in member 12. As is apparent in the drawings, and particularly FIGS. 1 and 4, the thickness of the sidewall of member 12 is substantially greater than the thickness of the sidewall of sleeve 34.

A detent broadly designated 50 comprises a ball 52 and a spring 54 received in a radially extending bore 56 in the outer enlarged section 20 of member 12. Detent 50 serves to releasably secure sleeve 34 in either the position thereof to permit functioning of the brake 12 as a muzzle brake for the firearm or in the alternate position disabling the brake from its braking function. To this end, a pair of holes 58 and 60 are located in sleeve 34 and extend transversely through the sidewall thereof as shown best in FIG. 4 of the drawing- The holes 58 and 60 are appropriately positioned for releasably locking the sleeve in either its braking functional position or in its brake disabling position as will be readily understood.

Figure 3:
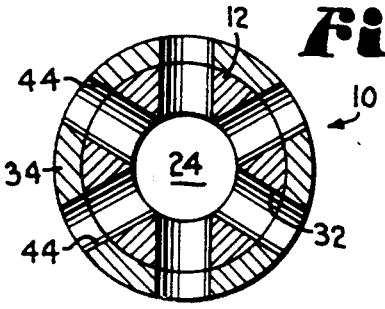
FIG. 3 is cross-sectional view taken along line 3—3 of FIG. 2.

In operation, if the shooter desires to employ muzzle brake 10 to minimize recoil in the firearm, he or she merely manually rotates sleeve 34 to the relative position shown best in FIGS. 2 and 3 of the drawing. This position, with the openings 32 aligned with the holes 44, permits a portion of the discharged gases to exit through conduits 46 while the projectile exits the muzzle brake through passage 24. The sudden change of direction of the rapidly moving discharged gases through the side of the muzzle brake exerts a substantial forwardly directed force on the muzzle brake. This forwardly directed force is transferred to the firearm to substantially reduce the backwardly directed recoil of the weapon.

If the shooter desires to eliminate the muzzle brake function to reduce muzzle blast or for any other reason, he or she can simply manually rotate sleeve 34 to its alternate position wherein the areas 48 block the openings 32. This prevents the flow of gases outwardly to the side of the muzzle brake and eliminates the braking function of the device.

While the optimum number, size and placement of the openings 32 and holes 44 may not be fully known, empirical data has shown that the optimum configuration varies according to the caliber of the firearm to which the muzzle brake 10 is attached. For example, it has been discovered that an arrangement of forty-two holes 44 and corresponding openings 32 of a diameter of approximately 0.1495 inches is particularly effective for a muzzle brake 10 affixed to a firearm with a caliber ranging from 0.22 to 0.30. It would also appear that a muzzle brake 10 possessing thirty-six holes 44 and corresponding openings 32 of approximately 0.1800 inches in diameter is effective when used with a firearm having a .375 to .458 caliber. It is to be understood, however, that the subject invention clearly contemplates that other configurations and arrangements may prove workable and, thus, such configurations and arrangements are within the ambit of the present invention.

Although the description and drawings show the use of brake 10 with a rifle, it is to be understood that the principals of this invention embodied in the muzzle brake described can be used with other firearms such as pistols or shotguns. In such event, the means for attaching the muzzle brake to the weapon would need to be modified to accommodate the characteristics of the weapon involved.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having described the invention, what is claimed is:

1. A muzzle brake for a firearm, said muzzle brake comprising:

a tubular member adapted to be mounted to the muzzle of a firearm in forwardly projecting longitudinal extension of the firearm barrel, said member having an axially extending passage aligned with the bore of the firearm barrel when the member is mounted on said muzzle, the passage being disposed to permit a projectile from the barrel to pass through the member, said member having a plurality of gas escape openings extending transversely through the sidewall of the member and communicating with said passage, there being openings disposed at spaced intervals substantially entirely around said member;

a tubular sleeve telescoped over said member, the sleeve having a plurality of holes disposed for alignment with said openings of the member to permit gas escaping from said openings to exit the brake when the sleeve is in one position with respect to the member, there being a hole for each opening, respectively, the member having areas without holes which areas are alignable with said openings to prevent escape of gas through said openings when the sleeve is in a second position with respect to the member; and means mounting the member and the sleeve in said telescoped relationship for selective manual movement of the sleeve between said one position and said second position.

2. A muzzle brake as set forth in claim 1, wherein said member and said sleeve are rigid.

3. A muzzle brake as set forth in claim 2, wherein the sidewall of said tubular member is substantially thicker than the sidewall of the sleeve so that the openings through the member are longer than the holes through the sleeve, whereby more of force from said exiting gases are applied to the stationary member than are applied to said movable sleeve.

4. A muzzle brake as set forth in claim 1, wherein said member is configured to present shoulder means disposed to engage the sleeve when the latter is telescoped over the member, said shoulder means being disposed to prevent movement of the sleeve relative to the member in one direction axially of the member.

5. A muzzle brake as set forth in claim 4, wherein said sleeve is provided with a shoulder adapted to engage a proximal shoulder on said firearm barrel, when the brake is installed on said barrel, to prevent movement of the sleeve relative to the member in the direction opposite said one direction actually of the member.

6. A muzzle brake as set forth in claim 1, wherein said member is adapted to be rigidly mounted on said firearm, and wherein the sleeve is mounted on the member for rotation with respect to the member.

7. A muzzle brake as set forth in claim 6, wherein the sleeve is mounted on the member for relative rotation with respect to the member about the longitudinal axis of the latter.

8. A muzzle brake as set forth in claim 3, wherein the brake includes releasable lock means operably connected with the member and sleeve respectively for holding the sleeve against inadvertent rotation relative to the member when the sleeve is in either said first position or said second position.

9. A muzzle brake as set forth in claim 7, wherein the openings through the member are arranged in a plurality of circumferentially spaced apart rows extending longitudinally of the member, the holes through the sleeve being arranged in rows alignable with the rows of openings in the member, said areas being spaced circumferentially from the rows in the sleeve.

10. A muzzle brake as set forth in claim 9, wherein the sleeve has the same number of rows of holes as the member has rows of openings, the sleeve areas being disposed between adjacent rows of holes.

* * * * *

UNITED STATES PATENT AND TRADEMARK OFFICE

CERTIFICATE OF CORRECTION

PATENT NO. : 5,333,529

DATED : August 2, 1994

INVENTOR(S) : James W. Brockman

It is certified that error appears in the above-indentified patent and that said Letters Patent is hereby corrected as shown below:

Column 6, line 66, "claim 3" should read -- claim 7 --.

Signed and Sealed this

Third Day of January, 1995

*Attest:*

*Attesting Officer*

BRUCE LEHMAN

*Commissioner of Patents and Trademarks*